US006190203B1

(12) United States Patent
Murakami et al.

(10) Patent No.: US 6,190,203 B1
(45) Date of Patent: Feb. 20, 2001

(54) WATERPROOF CONNECTOR AND METHOD OF ASSEMBLING THE SAME

(75) Inventors: Takao Murakami; Masaru Fukuda, both of Shizuoka-ken (JP)

(73) Assignee: Yazaki Corporation, Tokyo (JP)

( * ) Notice: Under 35 U.S.C. 154(b), the term of this patent shall be extended for 0 days.

(21) Appl. No.: 09/413,724

(22) Filed: Oct. 7, 1999

(30) Foreign Application Priority Data

Oct. 27, 1998 (JP) ..... 10-306058

(51) Int. Cl.[7] ..... H01R 13/40

(52) U.S. Cl. ..... 439/587; 439/274; 439/397; 439/400; 439/417

(58) Field of Search ..... 439/274, 275, 439/278, 279, 587, 589, 598, 400, 401, 417, 397, 246, 247, 248, 404

(56) References Cited

U.S. PATENT DOCUMENTS

| | | | | |
|---|---|---|---|---|
| 5,066,242 | * | 11/1991 | Martucci | 439/281 |
| 5,076,806 | * | 12/1991 | Hotea et al. | 439/595 |
| 5,498,172 | * | 3/1996 | Noda | 439/404 |
| 6,116,952 | * | 9/2000 | Nakata | 439/587 |

* cited by examiner

*Primary Examiner*—Paula Bradley
*Assistant Examiner*—Truc Nguyen
(74) *Attorney, Agent, or Firm*—Oblon, Spivak, McClelland, Maier & Neustadt, P.C.

(57) ABSTRACT

Disclosed are a waterproof connector and a method of assembling the same. The waterproof connector is equipped with an inner housing having formed therein a plurality of the terminal accommodation compartments, a seal housing connected to the inner housing in such a way as to be freely movable relative to the inner housing in a direction intersecting the axial direction of an electric wire substantially at right angles thereto, and an outer housing into which the inner housing and the seal housing are freely detachably fitted. In one wall portion of the seal housing opposing the terminal accommodation compartments, electric wire insertion-through-holes are formed. On an inner side of the one wall portion that oppose the electric wire insertion-through-holes, rubber plug accommodation recessed portions are formed. And the electric wires passed through the electric wire insertion-through-holes and the rubber plugs accommodated in the rubber plug accommodation recessed portions are connected to their corresponding terminals accommodated in the terminal accommodation compartments.

7 Claims, 4 Drawing Sheets

WATERPROOF CONNECTOR AND METHOD OF ASSEMBLING THE SAME

BACKGROUND OF THE INVENTION

The present invention relates to a waterproof connector and a method of assembling the same. More particularly, the invention concerns a miniaturized multi-polar waterproof connector whose connector housing and terminals are connected to each other to thereby enhance the waterproofness of a plurality of electric wires, and a method of assembling the waterproof connector.

In recent years, there has been proposed a miniaturized multi-polar waterproof connector whose connector housing and terminals are connected to each other to thereby enhance the waterproofness of a plurality of electric wires, and a method of assembling the waterproof connector, which suits the construction of it.

Japanese Patent Application Laid-Open Publication No. H10-60096 as filed by the applicant of this application relates to a waterproof connector that waterproofs a plurality of electric wires and terminals by using rubber plugs and pieces of packing, and to a method of assembling it.

SUMMARY OF THE INVENTION

According to the study by the present inventors, the above-described waterproof connector has an outer housing and an inner housing and is equipped with a spacer that has been fitted into the outer housing. In this construction, it is preferable to have a construction wherein, after a plurality of electric wires have been passed through the rubber plugs that have been accommodated in rubber-plug accommodation recessed portions of the outer housing, these electric wires are set to the positions of pressure contact thereof with the female terminals that have been accommodated in terminal accommodation compartments of the inner housing.

However, in this construction, in order to accurately guide the electric wires with an auto operation machine such as a robot, it is dispensable to take some procedure of, for example, installing some mechanism such as a guide between the inner housing and the outer housing, or newly gripping the electric wires again. It is difficult to conform the connector of this construction to such an auto operation machine as it is.

Also, in this construction, after having forcedly connected the electric wires to the female terminals, it is necessary to fit the inner housing into the outer housing side. In this case, because the rubber plugs are accommodated beforehand in the rubber-plug accommodation recessed portions of the outer housing, when sliding the electric wires relative to their corresponding electric wire insertion-through-holes of the spacer and the outer housing and thereby fitting the inner housing into the spacer that has been fitted in the outer housing, the rubber plugs press the electric wires. As a result of this, it is considered that the electric wires become likely to be buckled due to the slide resistance resulting from this pressing force and this has an adverse effect on the assembling efficiency of the waterproof connector.

Also, in this construction, in a case where the outer housing forming an outer shell has been broken, unless cutting the electric wires and replacing the outer housing and thereafter performing the operation of forcedly connecting the electric wires to the female terminals once again, it can be the difficult to perform maintenance with respect to the waterproof connector.

In view of the above, the present invention has been made by making studies thereof, and has an object to provide a multi-polar waterproof connector that can enhance the assembling efficiency and the maintenance efficiency thereof as well as to provide a method of assembling such waterproof connector.

The waterproof connector of the present invention has a construction wherein a plurality of terminal accommodation compartments are formed; terminals each having corresponding one of electric wires to be connected thereto can be accommodated in corresponding one of the plurality of terminal accommodation compartments; and the plurality of terminal accommodation compartments and the electric wires are made sealable by use of corresponding one of rubber plugs. More specifically, the waterproof connector comprises: an inner housing in which the plurality of terminal accommodation compartments are formed; a seal housing to be connected to the inner housing in such a way as to be movable relative to the inner housing in a direction that intersects an axial direction of the electric wires substantially at right angles thereto; and an outer housing into which the inner housing and the seal housing are detachably fitted. Here, one wall portion of the seal housing that opposes the plurality of terminal accommodation compartments has formed therein electric wire insertion-through-holes through which the electric wires can be passed, and the one wall portion has formed therein rubber plug accommodation recessed portions, into which the rubber plugs can be accommodated, at positions on an inner side of the one wall portion that oppose the electric wire insertion-through-holes. And, the electric wires passed through the electric wire insertion-through-holes of the seal housing and through the rubber plugs accommodated within the rubber plug accommodation recessed portions are connected to the terminals accommodated within the terminal accommodation compartments of the inner housing.

With this construction, the seal housing is freely movable in a direction that intersects the axial direction of the electric wire substantially at right angles thereto, and so it is possible, immediately after having passed the electric wires through the electric wire through-holes of the seal housing, to guide the electric wires to the positions of connection thereof with the terminals. Also, since it is not necessary to newly grip the electric wires once again, it becomes easy to cope with the assembly operation with an auto operation machines.

Further, this contribution does not slide the electric wires with respect to the electric wire through-holes of the rubber plugs after the connection thereof to the terminals. Therefore, it is possible to enhance the assembling efficiency of the waterproof connector without buckling the electric wires.

More specifically, the inner housing, the seal housing, and the outer housing constitute a connector housing.

With this construction, even when the outer housing has been broken, etc. for some reason or other after completion of the assembling operation, it becomes possible to replace the outer housing without cutting the electric wires and thereby enhance the maintenance efficiency.

Also, an engaging/retaining portion is provided on one side surface of the inner housing while an engaging portion is provided on the portion of the seal housing opposing the engaging/retaining portion. Whereby, by engagement of the engaging/retaining portion with the engaging portion, the inner housing and the seal housing are made relatively movable in the direction intersecting the axial direction of the electric wires substantially at right angles thereto.

With this construction, because, by engagement of the engaging/retaining portion of the inner housing with the engaging portion of the seal housing, the inner housing and the seal housing are made relatively movable in the direction intersecting the axial direction of the electric wires substantially at right angles thereto, it is possible to easily and reliably perform the connection of the electric wires to the terminals. This makes it possible to enhance the assembling efficiency of the waterproof connector one step more highly.

Here, it is preferable the engaging/retaining portion that has been provided on the inner housing is a boss member; and that the engaging portion that has been provided on the seal housing is a frame member that surrounds the boss member because of the reliability on the relative movement and the simplicity of the construction.

Also, it is preferable that a plurality of the electric wires are forcedly connected to pressure contact blades of their corresponding the terminals because of the simplicity and the reliability of the connection.

On the other hand, a method of assembling a waterproof connector of the present invention is the one that accommodates terminals having electric wires to be connected thereto into a plurality of terminal accommodation compartments of a connector housing and seals the plurality of terminal accommodation compartments and the electric wires by use of rubber plugs, thereby assembling the waterproof connector. More specifically,the method comprises the steps of: inserting the rubber plugs into rubber plug accommodation recessed portions on an inner side of one wall portion of a seal housing that forms an inner shell of the connector housing; accommodating the terminals into the plurality of terminal accommodation compartments of an inner housing that is to be connected to the seal housing and forms an inner shell of the connector housing; passing the electric wires through the rubber plugs via a plurality of electric wire insertion-through-holes of the one wall portion of the seal housing, from the outside thereof; reaching the electric wires passed through, up to positions of the terminals accommodated within the plurality of terminal accommodation compartments; moving the inner housing and the seal housing relatively to each other in a direction intersecting an axial direction of the electric wires at substantially right angles thereto, thereby correspondingly connecting the electric wires to the terminals; and detachably fitting the inner housing and the seal housing into an outer housing forming an outer shell of the connector housing from a rear side thereof.

With this construction, after having connected the electric wires to the terminals of the inner housing, it is not needed to slide the electric wires with respect to the rubber plugs of the seal housing. Therefore, it is possible to smoothly assemble the electric wires to the connector without buckling them and therefore to assemble the multi-polar waterproof connector with an excellent level of waterproofness simply and in a short period of time. Therefore, it is possible to enhance the assembling operation as a whole one step more highly.

Further, because it has been arranged to detachably fit the inner housing and the seal housing, that have the electric wires connected thereto, into the outer housing from a rear side thereof, even when the outer housing is broken, etc. for some reason or other after completion of the assembling operation, it becomes possible to replace the outer housing without cutting the electric wires to thereby enhance the maintenance efficiency.

DETAILED DESCRIPTION OF THE PREFERRED EMBODIMENT

An embodiment of the present invention will now be explained in detail with suitable reference to the drawings.

Figure 1:
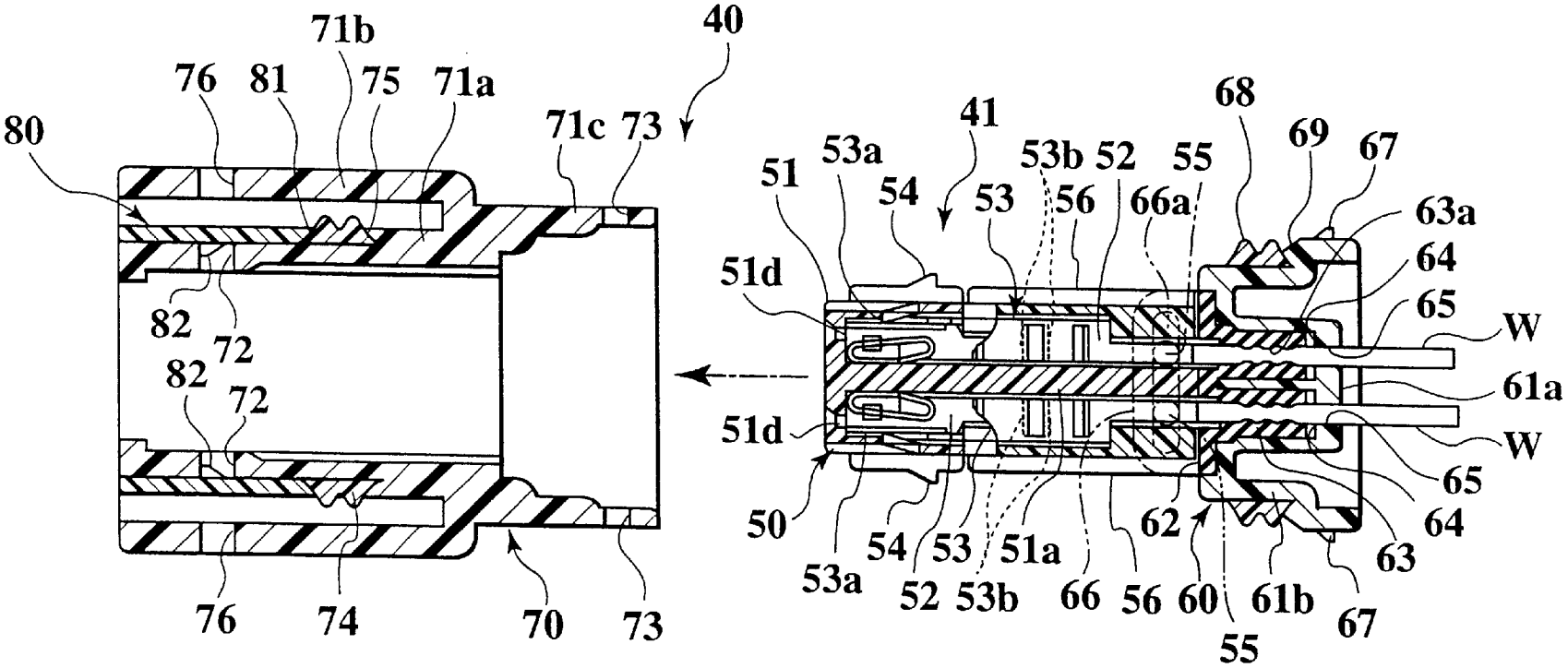
FIG. 1 is a sectional view illustrating a state prior to fitting of an inner housing and a seal housing of a waterproof connector according to an embodiment of the present invention into an outer housing of the waterproof connector according thereto from a rear side thereof.
Figure 2:
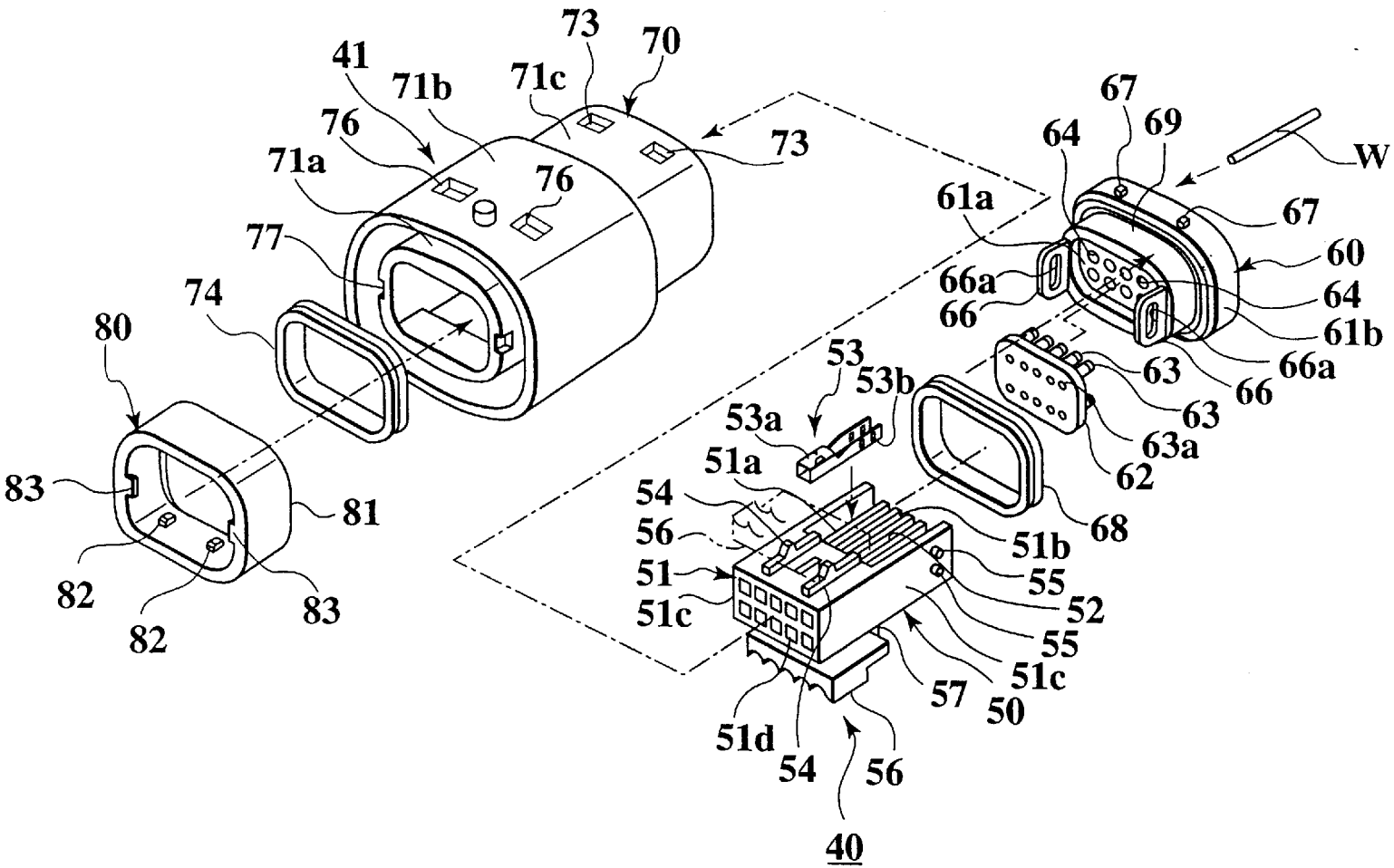
FIG. 2 is an exploded perspective view illustrating the waterproof connector.

FIG. 1 is a sectional view illustrating a state prior to fitting of an inner housing and a seal housing of a waterproof connector according to this embodiment of the present invention into an outer housing of the waterproof connector according thereto from a rear side thereof, and FIG. 2 is an exploded perspective view illustrating this waterproof connector.

As illustrated in FIGS. 1 and 2, a connector housing 41 of a waterproof connector 40 is constructed of an inner housing 50 that is made of synthetic resin and that has a plurality of terminal accommodation compartments 52 formed integrally therewith, a seal housing 60 that is made of synthetic resin and that has been connected to this inner housing 50 in such a way as to be freely movable in a direction that intersects the axial direction of an electric wire W at right angles thereto, an outer housing 70 that is made of synthetic resin and that has these inner housing 50 and seal housing 60 removably fitted therein, and a spacer 80 that is made of synthetic resin and that holds a waterproof packing 74 that is fitted into this outer housing 70 and thereby seals a mated connector not illustrated.

This inner housing 50 has a box portion 51 whose upper and lower surfaces are respectively opened at the rear side (upper side in FIG. 1). In the spaces that have been formed by a central horizontal wall 51*a* of the box portion 51 and respective upper and lower vertical side walls 51*b* thereof that serve concurrently as partitioning walls, terminal accommodation compartments 52 are respectively formed. And, in each of these terminal accommodation compartments 52, a female terminal (terminal) 53 is accommodated.

Also, on both sides of each of the upper and lower surfaces of the box portion 51, engaging/retaining pawls (engaging/retaining portions) 54 are respectively integrally formed so as to be projected from these surfaces. Also, on each of respective rear portions of both side surfaces (each constituting one side surface) 51*c*, 51*c* of the box portion 51, a pair of upper and lower engaging/retaining bosses 55, 55 are respectively integrally formed so as to be projected from these surfaces.

The upper and lower opening portions of the box portion 51 are made freely openable and closable, respectively, by use of a pair of lid members 56, 56 each serving concurrently as means for preventing the electric wire W after forced connection thereof to the female terminal 53 from being floated as well as means for preventing the female terminal 53 from being drawn off. These respective lid members 56 are integrally connected to the box portion 51 through a pair of hinges 57, 57.

At the positions of a front wall of the box portion 51 which oppose the respective terminal accommodation compartments 52, rectangular through-holes 51*d* into, which male terminals of the mated connector are inserted, are formed, respectively.

Figure 4A:
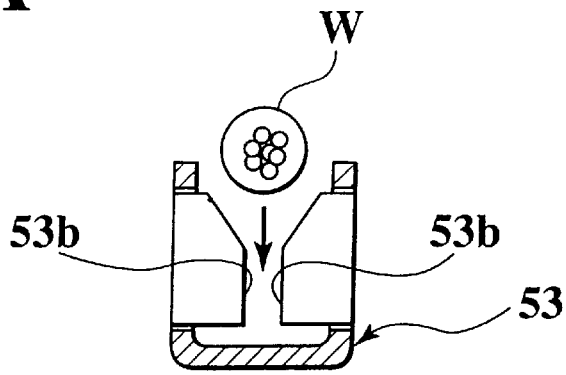
FIG. 4A is an explanatory view illustrating a state prior to forced connection of the electric wire to the terminal that has been accommodated in the terminal accommodation compartment of the inner housing.
Figure 4B:
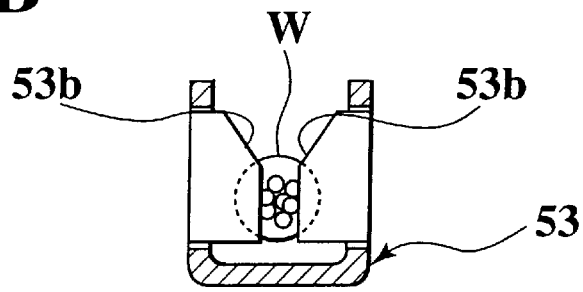
FIG. 4B is an explanatory view illustrating a state where the electric wire has been forcedly connected to this terminal.

As illustrated in FIG. 2 and further in FIGS. 4A and 4B, at both side plate portions of the female terminal 53 that are situated at a rear portion of a box portion 53*a* thereof, two pairs of pressure contact blades 53*b*, 53*b* are bent and formed, respectively.

And, the seal housing 60 is made into a box like member whose central part is protruded by use of a central wall portion (one wall portion) 61*a* that is substantially rectangular and shaped like a thick plate and a peripheral wall portion 61*b* that extends rearward from a peripheral edge portion of this central wall portion 61*a* and that is substantially square-hollow-cylindrical.

At the positions inside this central wall portion 61*a* that oppose the respective terminal accommodation compartments 52, rubber-plug accommodation recessed portions 64 are respectively formed. The recessed portions 64 are each relative large in diameter and circular in cross section. And into the recessed portions 64, respective waterproof rubber plugs 63, which have been integrally formed projectingly from a connection plate 62, are accommodated by forced insertion, etc. Also, on a rear side of the central wall portion 61*a*, electric-wire insertion-through-holes 65, which are each relative small in diameter and circular in cross section and through which the electric wires W are passed, are respectively formed in such a way as for these electric-wire insertion-through-holes 65 to communicate with the corresponding rubber-plug accommodation recesses portions 64. Each rubber plug 63 is formed into a substantially circular-hollow-cylindrical configuration whose inner- and outer-peripheral surfaces each have concavities and convexities, whereby the electric wires W are passed through electric-wire insertion-through-holes 63*a* thereof closely.

On the left and right sides (at the positions opposing the pairs of engaging/retaining bosses 55, 55 of the inner housing 50) on front outer sides of the central wall portion 61*a* of the seal housing 60, a pair of engaging frames (engaging portions) 66, 66 each having a vertically elongate hole 66*a* are respectively integrally formed so as to be projected from the seal housing 60. By each pair of engaging/retaining bosses 55, 55 of the inner housing 50 being inserted into and engaged with the vertically elongate hole 66*a* of the corresponding engaging frame 66 of this seal housing 60, the inner housing 50 and the seal housing 60 are moved relatively to each other in the direction intersecting the axial direction of the electric wire W at right angles thereto.

On both sides of each of the upper and lower surfaces of the peripheral wall portion 61*b* of the seal housing 60, substantially triangular-columnar engaging pawls (engaging portions) 67 are respectively integrally formed so as to be projected from the seal housing 60. The engaging pawls 67 are respectively engaged with or disengaged from engaging/retaining holes (engaging/retaining portions) 73 of corresponding each of the upper and lower surfaces of a rear wall portion 71*c* of the outer housing 70 as later described. Also, in the differing-in-level portion at the central part of the peripheral wall portion 61*b* of the seal housing 60, a V-shaped groove like packing-receiver portion 69 is integrally formed. The packing-receiver portion 69 receives an annular and rubber-made waterproof packing 68 therein.

And, the outer housing 70 is shaped into a substantially square-hollow-cylindrical configuration that is open on its front and rear surface sides, by a substantially square-hollow-cylindrical inner wall portion 71*a*, a substantially square-hollow-cylindrical outer wall portion 71*b* that encloses this inner wall portion 71*a* therein, and a substantially square-hollow-cylindrical rear wall portion 71*c* that connects together respective rear portions of the inner and outer wall portions 71*a*, 71*b* and extends rearward.

On both sides of each of front portions of the upper and lower walls of the inner wall portion 71*a* of the outer housing 70, rectangular engaging/retaining holes (engaging/retaining portions) 72 are respectively formed. With or from the engaging/retaining holes 72, the engaging/retaining pawls 54 on both sides of each of the upper and lower surfaces of the box portion 51 of the inner housing 50 are engaged or disengaged. Also, on both sides of a rear side of each of the upper and lower walls of the rear wall portion 71*c*, rectangular engaging/retaining holes (engaging/retaining portions) 73 are respectively formed. With or from engaging/retaining holes 73, the respective engaging/retaining pawls 67 on both sides of each of the upper and lower surfaces of the peripheral wall portion 61*b* of the seal housing 60 are engaged or disengaged.

At a large-depth portion of an outer surface side of the inner wall portion 71*a* of the outer housing 70, a V-shaped packing receiver portion 75 that receives an annular and rubber-made waterproof packing 74 is integrally formed.

On both sides of a front portion of each of the upper and lower walls of the outer wall portion 71*b* of the outer housing 70, engaging/retaining holes (engaging/retaining portions) 76 are respectively formed. With or from the engaging/retaining holes 76, flexible engaging/retaining arms of the mated connector not illustrated are engaged or disengaged.

At the centers of both of the left and right sides of the inner wall portion 71*a* of the outer housing 70, rectangular notches 77 are respectively formed.

And, the spacer 80 is formed into a substantially square-hollow-cylindrical configuration that is fitted over the outer surface side of the inner wall portion 71*a* of the outer housing 70. The spacer 80 thereby holds, when fitting thereof into the outer housing 70 is completed, the packing 74 that is engaged with and retained by the packing receiver portion 75 of the inner wall portion 71*a* of the outer housing 70, by its forward end portion 81.

On the inner surface sides of each of the upper and lower walls of the spacer 80, engaging/retaining pawls (engaging/retaining portions) 82, which are engaged with or disengaged from the respective engaging/retaining holes 72 of the inner wall portion 71*b* of the outer housing 70, are integrally formed so as to be projected from the spacer 80.

At the positions (opposing the notches 77, 77 of both sides of the front end of the inner wall portion 71*a* of the outer housing 70) of a front end of the spacer 80, flange portions 83 are integrally formed so as to be projected from the spacer. When the spacer 80 is completely fitted into the outer housing 70, the flange portions 83 are fitted into the notches 77, 77.

Now, to assemble the waterproof connector 40 of this embodiment having the above-described construction, the procedures illustrated in FIGS. 3A to 3E are taken.

Figure 3A:
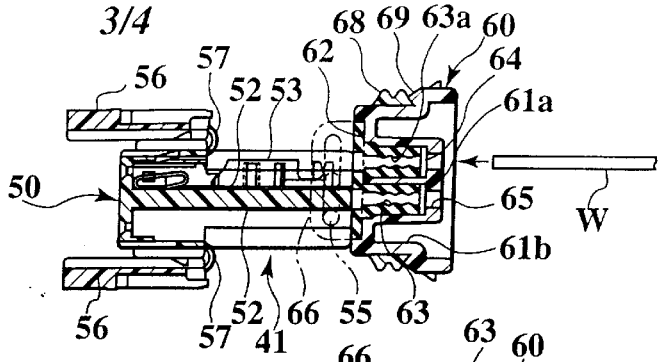
FIG. 3A is a sectional view illustrating a state prior to passing an electric wire through a rubber plug of the seal housing.

First, as illustrated in FIG. 3A, the female terminal 53 is accommodated and set beforehand in each of the respective terminal accommodation compartments 52 of the inner housing that forms the inner shell of the connector housing 41. Also, the waterproof packing 68 is inserted into and set in the packing receiver 69 of the peripheral wall portion 61*b* of the seal housing 60 that forms the inner shell of the connector housing 41 beforehand. And the rubber plugs 63 are inserted into and set in the respective rubber plug accommodation recessed portions 64 of the central wall portion 61*a* of the seal housing 60 beforehand. Then, the electric wires W are passed from the respective electric wire insertion-through-holes 65 of the central wall portion 61*a* of the seal housing 60 into the electric wire insertion-through holes 63*a* of the respective rubber plugs 63 from the outside.

Figure 3B:
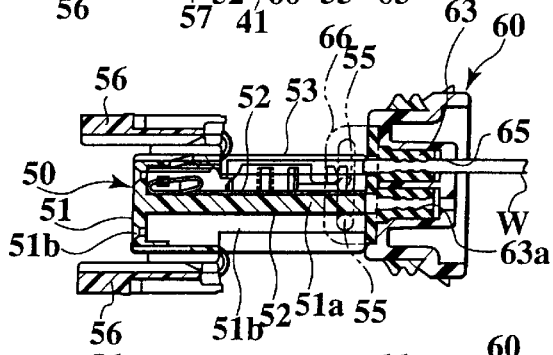
FIG. 3B is a sectional view illustrating a state where the electric wire has been passed through the rubber plug of the seal housing.

Next, as illustrated in FIG. 3B, the respective electric wires W are passed through the seal housing 60 and the inner housing 50, up to the position of the respective female terminals 53, that have been accommodated in the respective terminal accommodation compartments 52 of the inner housing 50, the inner housing 50 being connected to the pair of engaging frames 66 of the seal housing 60 via the respective pairs of engaging/retaining bosses 55 in such a way as to be relatively freely movable in the vertical direction intersecting the axial direction of the electric wires W at right angles thereto.

Figure 3C:
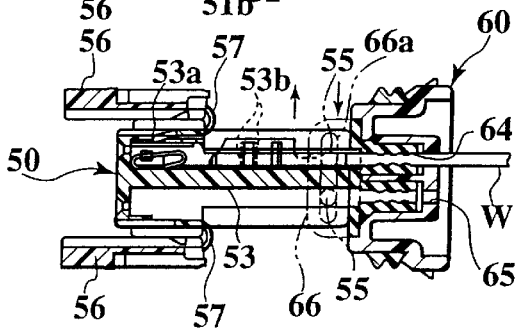
FIG. 3C is a sectional view illustrating a state where, by vertically moving the seal housing, the electric wire is connected to a terminal that has been accommodated in a terminal accommodation compartment of the inner housing.

Next, as illustrated in FIG. 3C, the inner housing 50 and the seal housing 60 are moved relatively to each other in the vertical direction intersecting the axial direction of the electric wires W at right angles thereto, via the respective engaging/retaining bosses 55 and their corresponding engaging/retaining frames 66, thereby forcedly connecting the respective electric wires W to the pairs of pressure contact blades 53*b*, 53*b* of the respective female terminals 53.

At this time, because the inner housing 50 and the seal housing 60 are relatively moved in the vertical direction, as illustrated in FIGS. 4A and 4B one end portion of each electric wire W can be set right above the pair of pressure contact blades 53*b*, 53*b* of the female terminal 53 without bending the electric wire W. Further, the forced connection thereof can be performed easily and reliably.

Figure 3D:
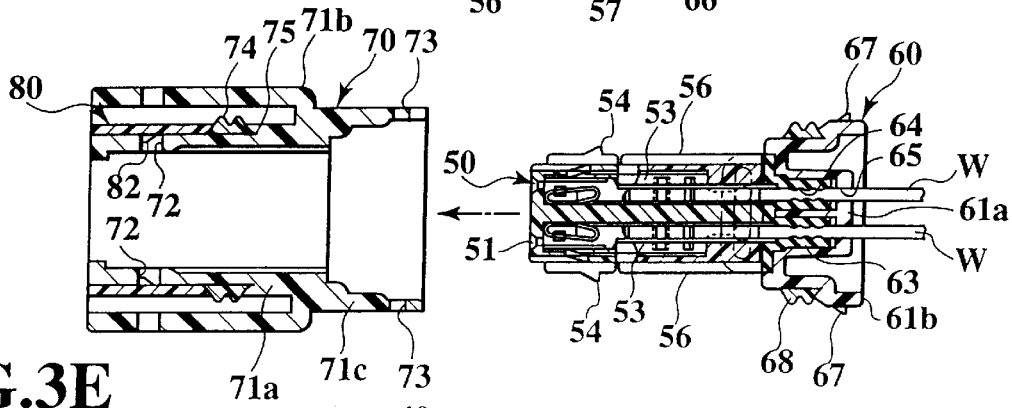
FIG. 3D is a sectional view illustrating a state prior to fitting of the inner housing and the seal housing into the outer housing from a rear side thereof.

Next, as illustrated in FIG. 3D, the respective lid members 56 of the inner housing 50 are closed to prevent the floatation of the respective electric wires W and the draw-off of the female terminal 53. Thereafter, the inner housing 50 and the seal housing 60 are fitted into the outer housing 70 forming an outer shell of the connector housing 41 from a side that is rear from the rear wall portion 71*c*.

At this time, the waterproof packing 74 and the spacer 80 are inserted into and set in the packing receiver portion 75 of the inner wall portion 71*a* of the outer housing 70 beforehand.

Figure 3E:
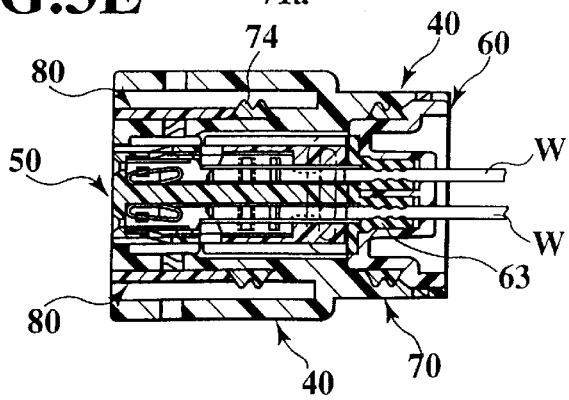
FIG. 3E is a sectional view illustrating a state where the assembling of the waterproof connector is completed.

And, as illustrated in FIG. 3E, when fitting of the inner housing 50 and the seal housing 60 into the outer housing 70 is completed, the respective engaging/retaining pawls 54 of the box portion 51 of the inner housing 50 are engaged with and retained by the respective engaging/retaining holes 72 of the inner wall portion 71*a* of the outer housing 70 while, on the other hand, the respective engaging/retaining pawls 67 of the peripheral wall portion 61*b* of the seal housing 60 are engaged with and retained by the respective engaging/retaining holes 73 of the rear wall portion 71*c* of the outer housing 70. As a result of this, the assembly of the waterproof connector 40 is completed.

Further, after completion of the assembling operation, the engagement and retention between the respective engaging/retaining holes 72 of the inner wall portion 71*a* of the outer housing 70 and the respective engaging/retaining pawls 54 of the box portion 51 of the inner housing 50 are released while the engagement and retention between the respective engaging/retaining holes 73 of the rear wall portion 71*c* of the outer housing 70 and the respective engaging/retaining pawls 67 of the peripheral wall portion 61*b* of the seal housing 60 are released. By doing so, it is possible to detach the inner housing 50 and the seal housing 60 from the outer housing 70 from the rear wall portion 71*c* side thereof and demount the former from the latter.

As has been described above, in this embodiment, it has been arranged that the inner housing 50 and the seal housing 60 have been made relatively freely movable in the vertical direction intersecting the axial direction of the electric wire W at right angles thereto by the engagement between the respective engaging/retaining bosses 55 of the inner housing 50 and their corresponding respective engaging frames 66 of the seal housing 60. Therefore, after having passed the electric wires W through their respective electric wire through-holes 65 of the central wall portion 61*a* of the seal housing 60, as illustrated in FIG. 4A, it is possible to immediately guide the electric wires W to the forced-connection position at which they are to be forcedly connected to the female terminals 53 that have been accommodated in their corresponding terminal accommodation compartments 52 of the inner housing 50. In addition, as illustrated in FIG. 4B, it is possible to perform easy, reliable and forced connection of the electric wires W to their corresponding pair of pressure contact blades 53*a*, 53*a* of the female terminals 53. Of course, because there is also no need to newly hold the electric wires W with the hand again, it also becomes easy to cope with these procedural steps with an auto operation machine.

And, after having performed forced connection of the electric wires W to the female terminals 53 of the inner housing 50, it is not necessary to slide the electric wires W relative to the electric wire through-holes 63*a* of the rubber plugs 63 that have been accommodated in the rubber-plug accommodation recessed portions 64 of the seal housing 60. Therefore, the electric wires can be smoothly assembled without being buckled, and it is possible to assemble the multi-polar waterproof connector 40 with excellent waterproofness simply and shortly. This makes it possible to enhance the assembling efficiency of the entire connector one step more highly.

Further, it has been arranged that the inner housing 50 and the seal housing 60 already connected with the electric wires W are detachably fitted into the outer housing 70 from a rear side thereof. Therefore, even when the outer housing 70 is broken, etc. for some reason or other after completion of the assembling operation, it becomes possible to replace the outer housing without cutting the electric wires W. The maintenance efficiency is thereby enhanced.

Figure 5:
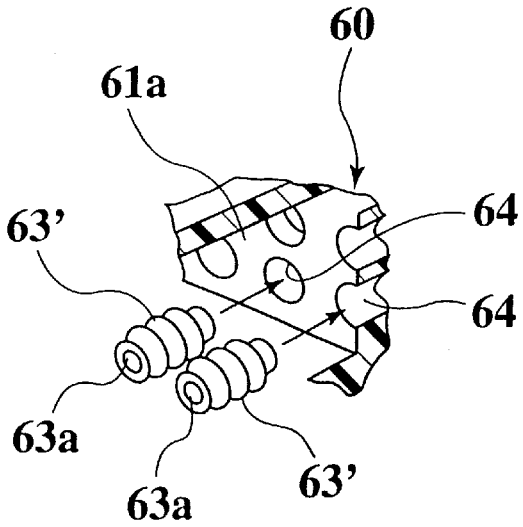
FIG. 5 is a perspective view illustrating a rubber plug in another form that is accommodated into a rubber-plug accommodation recessed portion of the seal housing.

Additionally, although according to this embodiment a construction has been made wherein the rubber plugs 63 were projectingly formed integrally with the connection plate 62, it is also possible to use the rubber plugs 63' that have individually separately been formed as illustrated in FIG. 5.

Also, although the lid member for preventing the floatation of the electric wires after the forced connection and the draw-off of the female terminals has been formed integrally with the box portion side of the inner housing via the hinge, this lid member may be formed separately from the box portion of the inner housing.

What is claimed is:

1. A waterproof connector wherein a plurality of terminal accommodation compartments are formed; terminals each having corresponding one of electric wires to be connected thereto can be accommodated in corresponding one of said plurality of terminal accommodation compartments; and said plurality of terminal accommodation compartments and said electric wires are made sealable by use of corresponding one of rubber plugs, comprising:

an inner housing in which said plurality of terminal accommodation compartments are formed;

a seal housing to be connected to said inner housing in such a way as to be movable relative to said inner housing in a direction that intersects an axial direction of said electric wires substantially at right angles thereto, one wall portion of said seal housing that opposes said plurality of terminal accommodation compartments having formed therein electric wire insertion-through-holes through which said electric wires can be passed, and said one wall portion having formed therein rubber plug accommodation recessed portions, into which said rubber plugs can be accommodated, at positions on an inner side of said one wall portion that oppose said electric wire insertion-through-holes; and an outer housing into which said inner housing and said seal housing are detachably fitted, wherein said electric wires passed through said electric wire insertion-through-holes of said seal housing and through said rubber plugs accommodated within said rubber plug accommodation recessed portions are connected to said terminals accommodated within said terminal accommodation compartments of said inner housing.

2. A waterproof connector according to claim 1, wherein said inner housing, said seal housing, and said outer housing constitute a connector housing.

3. A waterproof connector according to claim 1, wherein an engaging/retaining portion is provided on one side surface of said inner housing while an engaging portion is provided on a portion of said seal housing opposing said engaging/retaining portion, whereby, by engagement of said engaging/retaining portion with said engaging portion, said inner housing and said seal housing are made relatively movable in said direction intersecting said axial direction of said electric wires substantially at right angles thereto.

4. A waterproof connector according to claim 3, wherein said engaging/retaining portion provided on said inner housing is a boss member; and said engaging portion provided on said seal housing is a frame member that surrounds said boss member.

5. A waterproof connector according to claim 1, wherein each of said plurality of electric wires are forcedly connected to pressure contact blades of corresponding one of said terminals.

6. A method of assembling a waterproof connector, which accommodates terminals having electric wires to be connected thereto into a plurality of terminal accommodation compartments of a connector housing and seals said plurality of terminal accommodation compartments and said electric wires by use of rubber plugs, thereby assembling said waterproof connector, comprising:

inserting said rubber plugs into rubber plug accommodation recessed portions on an inner side of one wall portion of a seal housing that forms an inner shell of said connector housing;

accommodating said terminals into said plurality of terminal accommodation compartments of an inner housing that is to be connected to said seal housing and forms an inner shell of said connector housing;

passing said electric wires through said rubber plugs via a plurality of electric wire insertion-through-holes of said one wall portion of said seal housing, from the outside thereof;

reaching said electric wires passed through, up to positions of said terminals accommodated within said plurality of terminal accommodation compartments;

moving said inner housing and said seal housing relatively to each other in a direction intersecting an axial direction of said electric wires at substantially right angles thereto, thereby correspondingly connecting said electric wires to said terminals; and detachably fitting said inner housing and said seal housing into an outer housing forming an outer shell of said connector housing from a rear side thereof.

7. A waterproof connector comprising:

an inner housing having at least one terminal accommodation compartment with at least one terminal configured to receive an electric wire;

a seal housing configured to connect to said inner housing in such a way as to be movable relative to said inner housing in a direction that intersects an axial direction of the electric wire substantially at right angles thereto, a wall portion of said seal housing that opposes said at least one terminal accommodation compartment having formed therein at least one insertion-through-hole configured to receive the electric wire therethrough, said wall portion having formed therein at least one rubber plug accommodation recessed portion into which a rubber plug can be accommodated at positions on an inner side of said wall portion that oppose said at least one insertion-through-hole, said rubber plug being configured to seal said at least one terminal accommodation compartment and the electric wire; and an outer housing configured to detachably receive said inner housing and said seal housing.

* * * * *